US006780077B2

(12) United States Patent
Baumgartner et al.

(10) Patent No.: US 6,780,077 B2
(45) Date of Patent: Aug. 24, 2004

(54) MASTER AND SLAVE TOY VEHICLE PAIR

(75) Inventors: Chris T. Baumgartner, Pasadena, CA (US); Joseph T. Moll, Prospect Park, PA (US); Truman J. Gilbert, Phildelphia, PA (US); Stephen N. Weiss, Philadelphia, PA (US); Nathan Bloch, Cherry Hill, NJ (US); David V. Helmlinger, Mount Laurel, NJ (US); Gregory Nungester, Titusville, NJ (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 10/282,410

(22) Filed: Oct. 29, 2002

(65) Prior Publication Data

US 2003/0082987 A1 May 1, 2003

Related U.S. Application Data

(60) Provisional application No. 60/336,484, filed on Nov. 1, 2001.

(51) Int. Cl.[7] ..... A63H 30/00; A63H 30/04

(52) U.S. Cl. ..... 446/175; 446/454; 446/456

(58) Field of Search ..... 446/175, 454, 446/456; 318/675; 463/62, 63; 273/46

(56) References Cited

U.S. PATENT DOCUMENTS

| | | | | |
|---|---|---|---|---|
| 3,000,137 | A | | 9/1961 | Vine |
| 3,130,803 | A | | 4/1964 | Wiggins |
| 3,711,756 | A | * | 1/1973 | Lelandis ..... 316/675 |
| 3,892,086 | A | | 7/1975 | Gay et al. |
| 4,147,351 | A | | 4/1979 | Saito |
| 4,201,012 | A | | 5/1980 | Marshall |
| 4,245,430 | A | | 1/1981 | Hoyt |
| 4,334,221 | A | | 6/1982 | Rosenhagen et al. |
| 4,466,214 | A | | 8/1984 | Kulesza et al. |
| 4,627,511 | A | | 12/1986 | Yajima |
| 4,662,854 | A | | 5/1987 | Fang |
| 4,807,712 | A | | 2/1989 | Skottegard |
| 4,810,224 | A | | 3/1989 | DeVincent |
| 4,828,525 | A | | 5/1989 | Okano |
| 4,844,474 | A | | 7/1989 | Schaub et al. |
| 4,844,493 | A | | 7/1989 | Kramer |
| 4,865,575 | A | | 9/1989 | Rosenthal |
| 4,874,343 | A | | 10/1989 | Rosenthal |
| 4,894,042 | A | | 1/1990 | Kamikawa |
| 4,911,669 | A | | 3/1990 | Parker |
| 4,938,483 | A | | 7/1990 | Yavetz |
| 4,987,349 | A | | 1/1991 | Nakamura |
| 5,083,968 | A | | 1/1992 | Hart |
| 5,100,153 | A | | 3/1992 | Welte |
| 5,127,658 | A | | 7/1992 | Openiano |
| 5,137,103 | A | | 8/1992 | Cartmell |
| 5,180,023 | A | | 1/1993 | Reimers |
| 5,195,920 | A | | 3/1993 | Collier |
| 5,259,808 | A | | 11/1993 | Garr |
| 5,315,515 | A | | 5/1994 | Schmitz |
| 5,452,901 | A | | 9/1995 | Nakada et al. |

(List continued on next page.)

FOREIGN PATENT DOCUMENTS

| | | | |
|---|---|---|---|
| GB | 2119267 | * | 11/1983 |
| WO | WO 0015316 | * | 3/2000 |

*Primary Examiner*—Derris Banks
*Assistant Examiner*—Faye Francis
(74) *Attorney, Agent, or Firm*—Akin Gump Strauss Hauer & Feld, L.L.P.

(57) ABSTRACT

A toy vehicle combination includes a master toy vehicle and a slave toy vehicle. The master toy vehicle includes a transmitter configured to broadcast an IR tracking signal. The slave toy vehicle includes at least first and second directional IR receivers configured to receive the tracking signal from different directions around the slave toy vehicle and is configured to follow or evade the master toy vehicle, which is conventionally remotely controlled.

17 Claims, 20 Drawing Sheets

U.S. PATENT DOCUMENTS 5,517,098 A 5/1996 Dong
5,656,907 A 8/1997 Chainani et al.
5,697,829 A 12/1997 Chainani et al.
5,702,107 A 12/1997 Novak
5,803,789 A 9/1998 Dean et al.
5,882,241 A * 3/1999 Mullaney et al. ..... 446/462
6,039,626 A 3/2000 Gerold et al.
6,068,537 A 5/2000 Lupton
6,071,166 A 6/2000 Lebensfeld et al.
6,106,361 A 8/2000 Petris
6,171,172 B1 1/2001 Foster et al.
6,224,454 B1 5/2001 Cheng et al.
6,248,019 B1 6/2001 Mudie et al.
6,254,486 B1 7/2001 Mathieu et al.
6,308,114 B1 10/2001 Kim
6,482,064 B1 11/2002 Lund
6,491,566 B2 12/2002 Peters et al.
2003/0148703 A1 * 8/2003 Scott et al.

* cited by examiner

| D 21 | 22 | 23 | 24 |
|---|---|---|---|
| 0 | 0 | 0 | 0 |
| 0 | 0 | 0 | 1 |
| 0 | 0 | 1 | 0 |
| 0 | 0 | 1 | 1 |
| 0 | 1 | 0 | 0 |
| 0 | 1 | 0 | 1 |
| 0 | 1 | 1 | 0 |
| 0 | 1 | 1 | 1 |
| 1 | 0 | 0 | 0 |
| 1 | 0 | 0 | 1 |
| 1 | 0 | 1 | 0 |
| 1 | 0 | 1 | 1 |
| 1 | 1 | 0 | 0 |
| 1 | 1 | 0 | 1 |
| 1 | 1 | 1 | 0 |
| 1 | 1 | 1 | 1 |

MASTER AND SLAVE TOY VEHICLE PAIR

CROSS-REFERENCE TO RELATED APPLICATIONS

This application claims the benefit of U.S. Provisional Application No. 60/336,484, filed Nov. 1, 2001, entitled "Master/Slave Toy Vehicle Pair."

BACKGROUND OF THE INVENTION

The present invention relates to motorized toy vehicles and, more particularly, to remotely and automatically controlled toy vehicles.

Remote controlled (R/C) toys are generally well known in the art. Such R/C toys generally include a remote control having one or more manual actuators for controlling the movement and sometimes the mode of operation of the R/C toy vehicle. Generally, the R/C toy vehicle is turned on by a user and then the user utilizes the remote control to control movement of the R/C toy vehicle forward, reverse, left, right and combinations thereof In U.S. Pat. No. 4,938,483, at least one more complicated R/C toy vehicle play set includes not only multiple remote controls for controlling multiple R/C toy vehicles at the same time, but also a secondary transmitter and secondary receiver in each R/C toy vehicle such that different R/C toy vehicles can cause actions between one another. For example, in the one prior art R/C toy vehicle play set, a user controls a particular R/C toy vehicle to steer and drive and additionally causes the R/C toy vehicle to "fire" or emit a secondary transmit signal. Another user similarly, simultaneously and independently controls another R/C toy vehicle. If the other user's R/C toy vehicle is generally in the path of the secondary transmit signal and receives the secondary transmit signal, the other user's toy vehicle is either temporarily disabled electronically or loses a point or the like.

In U.S. Pat. No. 5,083,968, other self-powered toy vehicles have secondary sensors for tracking nearby heat sources (i.e., broadband infrared receivers), such as a human body. The sensors of the toy are mounted in a rotating head that is mounted, in turn, upon a wheel, track or light body that can move. The toy also includes sensors to detect unheated objects in its path and will act to avoid hitting them. The toy can either chase or move away from the heat source according to a particular mode of operation.

In U.S. Pat. No. 3,130,803, another similar self-powered toy vehicle is adapted to follow a path defined by light and dark areas. This toy vehicle has no remote control but rather traverses a path of light and dark areas that may be defined on any surface. The toy vehicle contains two photosensitive devices that change the resistance in accordance with the amount of light received. The photoconductors disposed on opposite sides of the vehicle guide the vehicle along the light areas of the pattern on the floor. A modified version of the toy vehicle includes a sensor to detect objects in its path. The mobile toy vehicle has an on-board forwardly facing transmitter for forwardly transmitting a transmission signal, e.g., an infrared light beam, ahead of the toy. The toy vehicle also has an on-board forwardly facing receiver, e.g., an infrared light detector, mounted on the toy for detecting and collecting a portion of the transmitted infrared light beam reflected off an obstacle located within a predetermined range. The toy vehicle has two modes of play. The first mode causes the toy to veer away from obstacles when detected, and the second mode causes the toy to attack an obstacle once detected. The second mode simply causes the toy to advance towards the obstacle rather than to veer away from it and if the obstacle moves away from the toy, the toy will pursue the obstacle in this mode.

What is valuable is toy vehicles having still different and novel play patterns from those already disclosed.

BRIEF SUMMARY OF THE INVENTION

Briefly stated, the present invention comprises a toy vehicle combination. The combination includes a master toy vehicle and a slave toy vehicle. Each toy vehicle includes a chassis with a plurality of supporting road wheels, a motive system drivingly coupled to at least one of the plurality of road wheels so as to propel the chassis and a steering system operably coupled to at least one of the plurality of road wheels so as to steer the chassis. The master toy vehicle includes a transmitter configured to broadcast a tracking signal, a radio frequency (RF) receiver configured to receive signals from an RF remote control, a master toy vehicle control circuit having a first output connected to the motive system of the master toy vehicle and a second output connected to the steering mechanism of the master toy vehicle. The master toy vehicle control circuit is configured to control the first and second outputs of the first control circuit based upon signals received by the RF receiver. The slave toy vehicle includes at least first and second directional receivers configured to receive the tracking signal from the transmitter from different directions around the slave toy vehicle, a slave toy vehicle control circuit coupled to the first and second directional receivers, a first output connected to the motive system of the slave toy vehicle, and a second output connected to the steering system of the slave toy vehicle. The slave toy vehicle control circuit is configured to control at least one of the first and second outputs of the slave toy vehicle control circuit based upon signals received by the first and second directional receivers.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
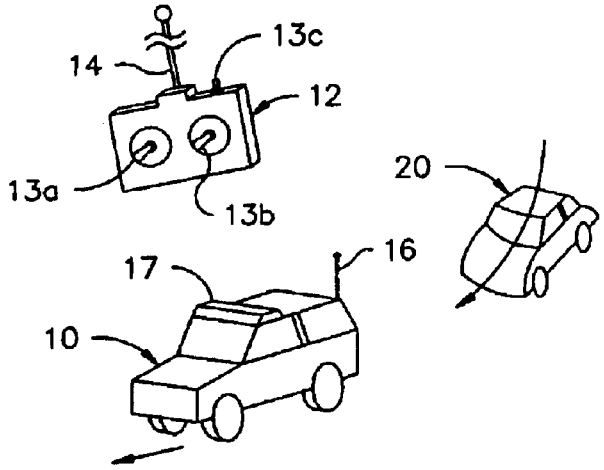
FIG. 1 is a perspective view of one master toy vehicle and slave toy vehicle combination in accordance with a first preferred embodiment of the present invention.

Certain terminology is used in the following description for convenience only and is not limiting. The words "right," "left," "lower" and "upper" designate directions in the drawings to which reference is made. The words "inwardly" and "outwardly" refer to directions toward and away from respectively, the geometric center of the device discussed and designated parts thereof. The terminology includes the words above specifically mentioned, derivatives thereof and words of similar import. Additionally, the word "a" as used in the claims and in the corresponding portions of the Specification means "one or more than one."

As used herein, "directional" generally indicates a particular or generally singular direction, and when used to describe a type of receiver or transmitter generally means a receiver or transmitter that is capable of receiving or sending signals in generally one direction only.

Referring to the drawings in detail, wherein like numerals indicate like elements throughout the several figures, there is shown in FIG. 1 a first exemplary master toy vehicle 10 and a first exemplary slave toy vehicle 20 of a master and slave toy vehicle pair in accordance with a first preferred embodiment of the present invention. The master toy vehicle 10 can be an otherwise ordinary remotely-controlled (R/C) vehicle which has been modified by the addition of a tracking signals source or transmitter indicated generally at 17 on the roof of the master toy vehicle 10. The master toy vehicle 10 is preferably remotely controlled, for example, radio controlled with a receiver and an antenna 16 by a conventional remote control transmitter ("remote control") 12 which includes manual actuators 13*a,* 13*b* for manual input of motive (i.e. "propulsion") and "steering" commands, an on-off switch and an antenna 14 connected to internal circuitry including a transmitter and controller (none depicted), which converts inputs through actuators 13*a,* 13*b* into command signals for radio transmission. The second toy vehicle 20 is a slave which runs under autonomous control and interacts with the master toy vehicle 10 by physically pursuing (or evading) the master toy vehicle 10. To achieve that capability, the slave toy vehicle 20 is provided with a plurality of signal sensors 21–24 (FIG. 2) which are responsive to the signal source 17 on the master toy vehicle 10. For example, the tracking signal source or transmitter 17 may be one infrared ("IR") light source but, more preferably, it is a plurality of directed IR light sources, such as four IR LED's 11–14 mounted in an array on the roof of the master toy vehicle 10 to transmit a predetermined (e.g., fixed frequency) IR signal essentially entirely around the master toy vehicle 10. Fewer or greater numbers of transmitters 11–14 can be used if less than 360° coverage or full and overlapping 360° coverage is desired or required around vehicle 10. The sensors 21–24 on the slave toy vehicle 20 might be directional IR receivers tuned to the frequency of the IR LED's of signal sources 11–14. An on-board microprocessor or microcontroller 30 (FIG. 3) in the slave toy vehicle 20 monitors the states of the various sensors 21–24 and controls the slave toy vehicle 20 to pursue the master toy vehicle 10. The four IR LED signal sources 11–14 and their preferred fields of view 11'–14' are indicated schematically in FIG. 2. Conventional IR sensors typically have a 90° field of view. At least four IR sensors 21–24 disposed at 90° orientations are required for "full" coverage around the slave toy vehicle 20 without overlap. Preferably, the IR sensors 21–24 are overlapped towards the front of the slave toy vehicle 20 as shown to provide greater resolution of the relative location of the tracking signal source 17 and the master toy vehicle 10 with respect to the slave toy vehicle 20. Preferably, overlapping coverage is at least provided directly in front of the slave toy vehicle 20 so that the slave toy vehicle 20 can position itself directly behind the master toy vehicle 10, which is designed to be impacted from behind by the slave toy vehicle 20 as would occur if the master toy vehicle 10 were trying to escape pursuit of the slave toy vehicle 20.

Of course, the present invention is not limited to IR LEDs 11–14, but may include other signal sources 17 which emit electromagnetic waves of other spectrums such as visible light or which emit sound, RF, microwave and the like without departing from the broad inventive scope of the present invention. Likewise, the signal sensors 21–24 may include sensors other than IR sensors such as other forms of electromagnetic wave detectors, microphones, piezo or silicone devices, vibration sensors and the like. Preferably, the signal sensors 21–24 are directional in order to determine a particular source direction being detected for tracking purposes, but need not be. It is contemplated that the signal sensors 21–24 could be made directional by mechanical means such as installing the signal sensors 21–24 in directional cones (not shown) or the like, thereby mechanically limiting the field of view of the signal sensors 21–24. In sum, any other directional antenna or transmitting source can be utilized as the signal source 17 used in conjunction with signal sensors 21–24 capable of receiving or detecting that particular type of signal source 17 without departing from the present invention.

Figure 3:
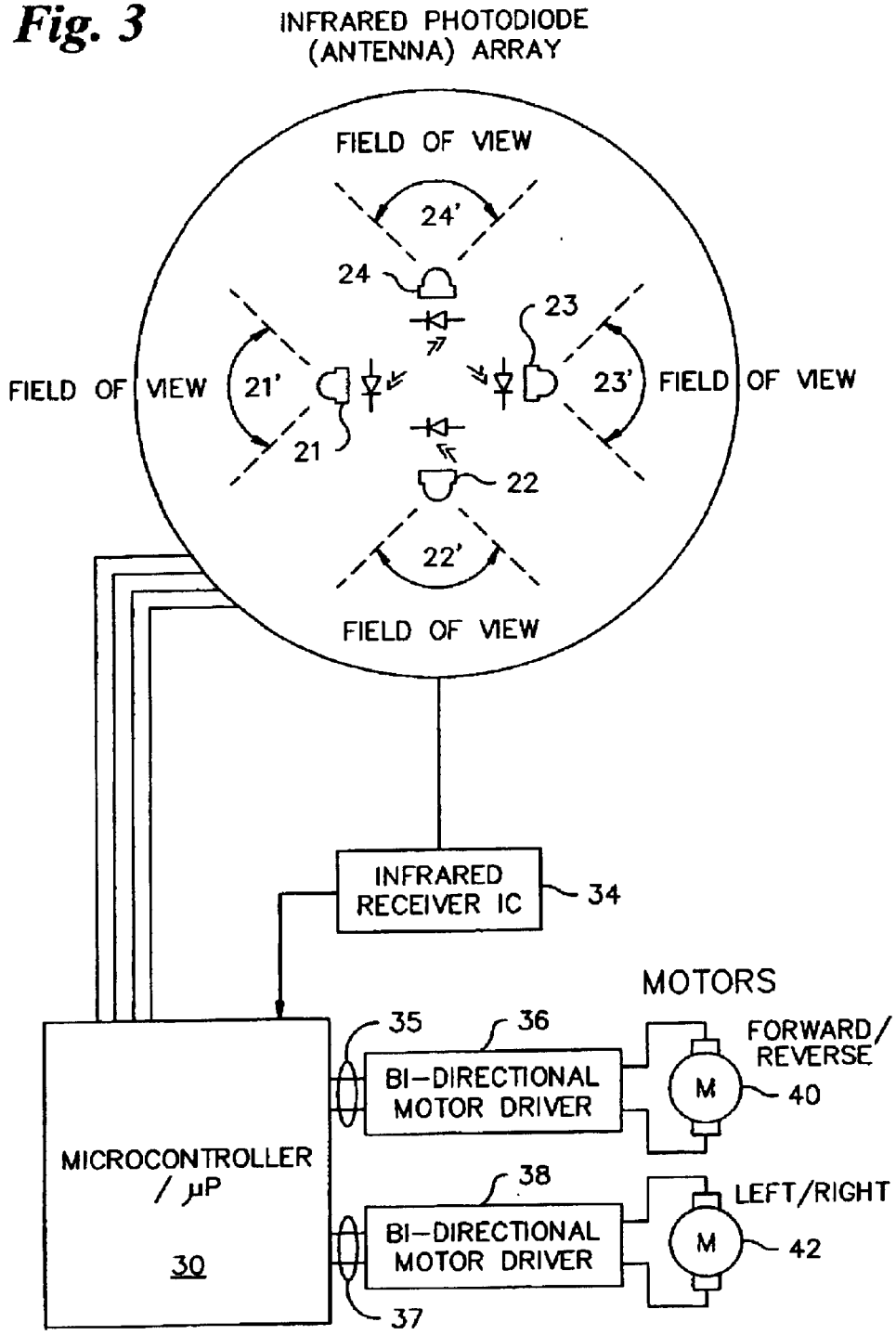
FIG. 3 is a block diagram of the control for the slave toy vehicle of FIG. 1.

FIG. 3 is a block diagram of the major electrical components of the slave toy vehicle 20. The IR sensors 21–24 are coupled with a controller in the form of a programmed microcontroller 30 by suitable means. In FIG. 3, the IR sensors 21–24 coupled to the microcontroller 30 directly; however, an IR receiver integrated circuit (IC) 34 may be used to communicate data from the IR sensors 21–24 to the microcontroller 30 without departing from the present invention. The output of the IR receiver IC 34 is sent to the microcontroller 30 in the slave toy vehicle 20. It is further contemplated that a high impedance multiplexer (not shown) could be provided between the IR sensors 21–24 and/or the IR receiver IC 34 and the microcontroller 30 so as to reduce the required number of inputs in the microcontroller 30. The particular circuit implementation utilized is not critical to the present invention and my be implemented in other configurations as are known in the art without departing from the present invention. Based on the state of the sensors 21–24, the microcontroller 30 controls through signal outputs to appropriate driver circuits 36, 38, motors 40, 42 thereby controlling propulsion and steering respectively of the slave toy vehicle 20 to pursue the master toy vehicle 10 as will be explained below.

Figures 4, 5:
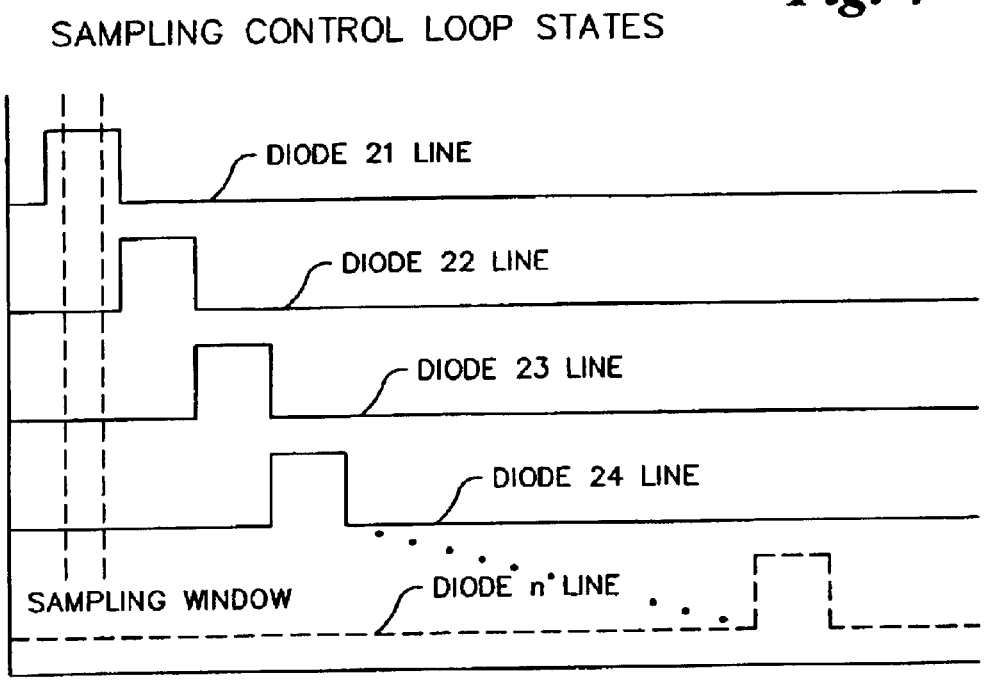
FIG. 4 depicts a set of sampling signals generated by the sensors of the slave toy vehicle of FIGS. 1–2.
FIG. 5 depicts a state table for the slave toy vehicle of FIG. 1.

FIG. 4 depicts interaction between either the IR sensors 21–24 or the IR receiver IC 34 and the microcontroller 30. The particular IR sensors 21–24 being used in the exemplary slave toy vehicle 20 are normally high. That is, the IR sensors 21–24 output a high level signal unless they sense an appropriate IR light source. Then their output signal level goes low. The four sensor signals in FIG. 4 are all high when sampled, indicating that the master toy vehicle 10 is not being sensed by the slave toy vehicle 20.

Figure 2:
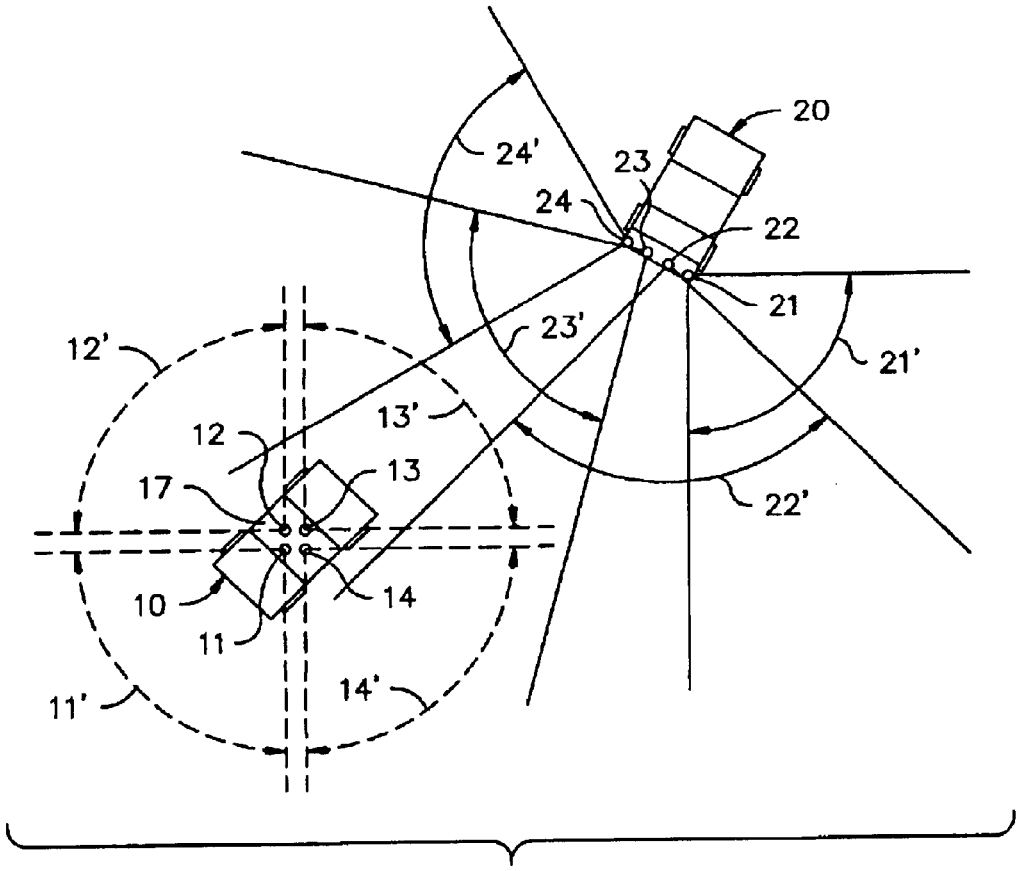
FIG. 2 shows areas of signal transmission by the master toy vehicle of FIG. 1 and of sensor reception by the slave toy vehicle of FIG. 1.

FIG. 5 represents a state table for the signal sensors 21–24 of the slave toy vehicle 20 of FIGS. 1 and 2. The states represent the opposite values to the signal level from the sensors 21–24. For example, the signal level of the four signal sensors 21–24 in FIG. 4 are all high indicating none of the four sensors 21–24 sense the IR signal source 17 of the master toy vehicle 10. This state is represented by the first line (0000) in the state table of FIG. 5. The second line (0001) represents a positive response by the fourth detector 24. The fourth line (0011) represents an overlapping response from the third and fourth detectors 23, 24, etc. In this way, the location of the master toy vehicle 10 with respect to the slave toy vehicle 20 is determined. The microcontroller 30 is preprogrammed to autonomously steer the slave toy vehicle 20 to pursue the master toy vehicle 10. For example, this may be done by means of a look-up table, the microprocessor 30 providing parallel line outputs 35, 37 containing a forward propulsion command and steering adjustment command, respectively, to the two motors 40, 42, respectively, to attempt to center the slave toy vehicle 20 directly behind the master toy vehicle 10 to keep the master toy vehicle 10 in the overlapped sectors 22', 23' between the second and third detectors 22, 23 directly in front of the slave toy vehicle 20. The slave toy vehicle 20 can thus follow the master toy vehicle 10 in near real time as the detection of the master toy vehicle 10 by the slave toy vehicle 20 and the adjustment of the slave toy vehicle 20 steering and propulsion is performed many times per second (i.e. at the cycling speed of the multiplexer 32 and integrator 34). The microcontroller 30 can be programmed or configured to follow motion of the master toy vehicle 10. For example, the microcontroller 30 can be programmed to determine that the master toy vehicle 10 has moved from sector 21' to the overlapped region of sectors 21' and 22', and therefore, the master toy vehicle 10 is traveling from left to right with respect to the slave toy vehicle 20. Thus, the slave toy vehicle 20 could be programmed to move predictively in order to anticipate where the master toy vehicle 10 will be so as to increase the skill level required by the user necessary to avoid the slave toy vehicle 20 in play as described in greater detail hereinafter.

The master and slave toy vehicles 10, 20 can have any variety of different forms and modes of operation and can be made to interact in more ways than simply the pursued/pursuer relation without departing from the broad inventive scope of the present invention.

Figure 6:
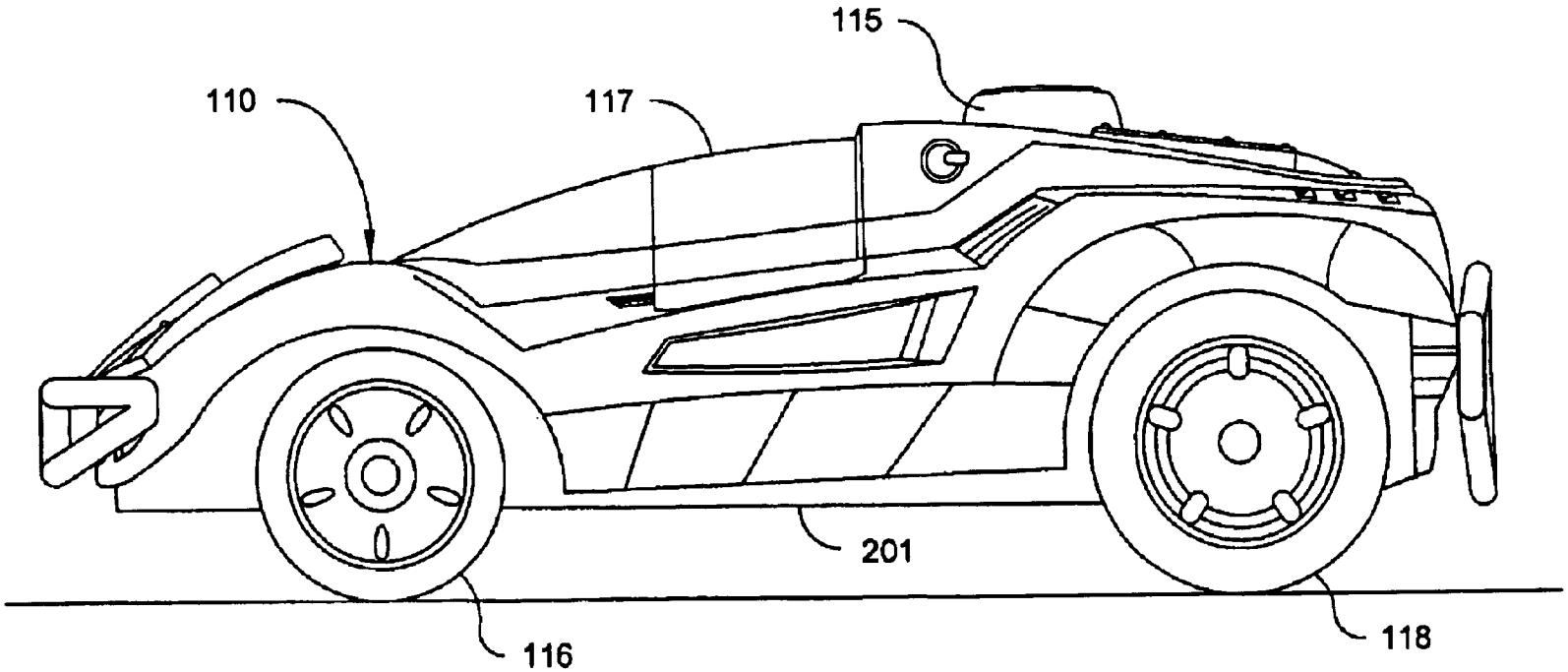
FIG. 6 is a side elevation view of a second master toy vehicle in accordance with a second preferred embodiment of the present invention.
Figure 7:
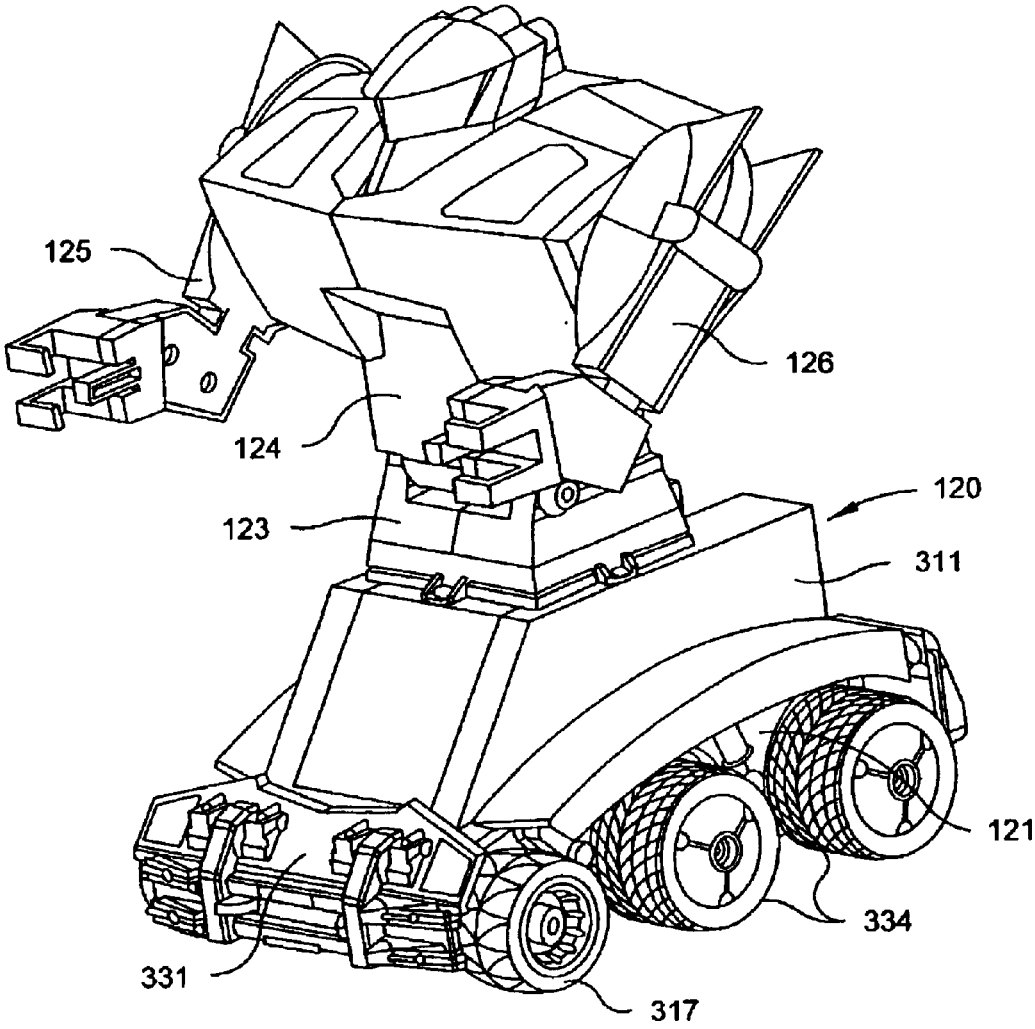
FIG. 7 is a perspective view of a second slave toy vehicle having a robotic upper body in accordance with the second preferred embodiment of the present invention.

FIGS. 6 and 7 depict a second master toy vehicle 110 and a second slave toy vehicle 120, respectively, of a second combination in accordance with a second preferred embodiment of the present invention. The master toy vehicle 110 is conventional four-wheeled remotely-controlled toy vehicle having a steering motor 142 configured to pivot the two front road wheels 116 about vertical axes and a propulsion motor 138 for driving the two rear road wheels 118 on a solid axle in the same forward or rearward direction. The master toy vehicle 110 has a tracking signal source 115 on the roof of the vehicle directly of a cockpit 117 roughly in the center of the master toy vehicle 110.

The slave or chasing toy vehicle 120 shown is six-wheeled having two smaller front road wheels 317, which are unpowered, and four larger center and rear road wheels 324, which are powered. The slave toy vehicle 120 preferably has what is called "tank steering". This means there are two drive motors 182, 186 in the slave toy vehicle 120 each independently driving one or more road wheels 317, 334 on separate sides of the vehicle 120. More particularly, slave toy vehicle 120 can be driven in forward and rearward directions by rotating all powered wheels 334 to move in the same direction. The slave toy vehicle 120 can be steered by driving the powered road wheels 334 on one side of the slave toy vehicle 120 in a forward or rearward direction and leaving the powered road wheels 334 on the opposite side of the slave toy vehicle 120 undriven or driven differently, i.e. at a different speed or in a different direction or both. The slave toy vehicle 120 can be rotated in place by driving the powered road wheels 334 on opposite sides of the slave toy vehicle 120 in opposite (forward/rearward) directions.

Figure 8:
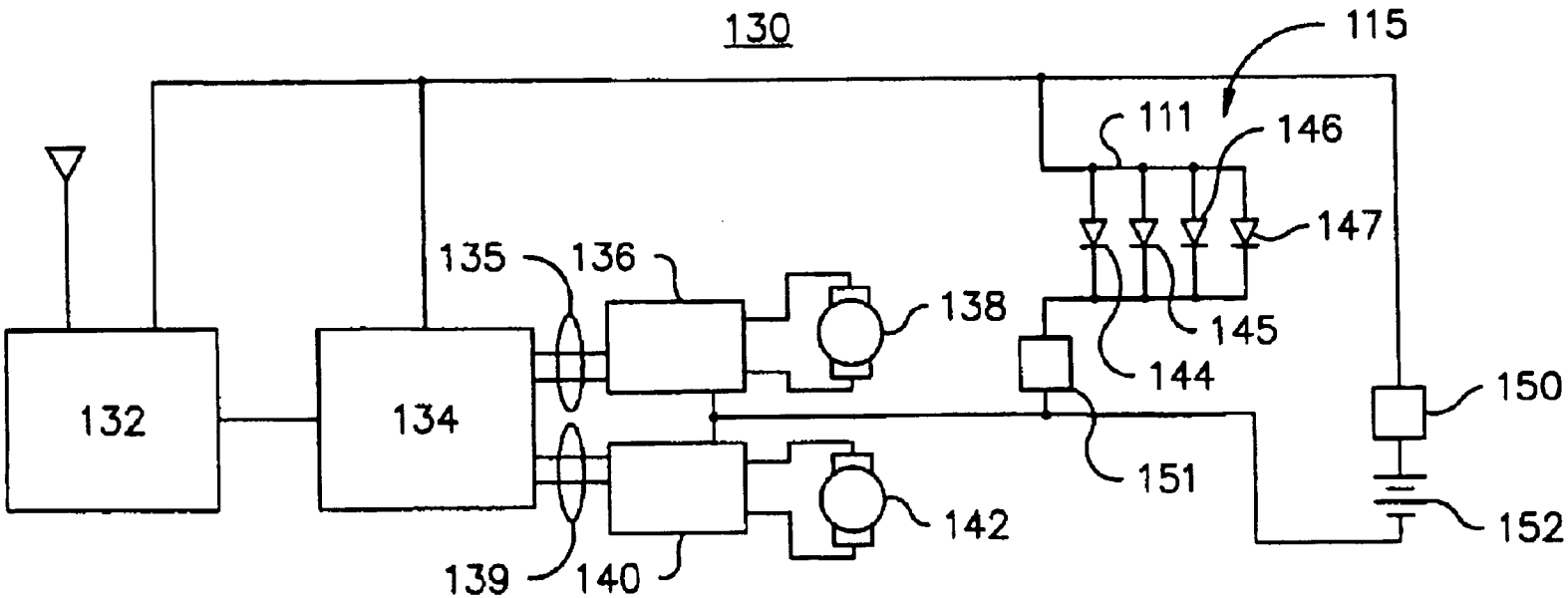
FIG. 8 is an electrical schematic diagram of the major components of the electrical circuitry of the second master toy vehicle of FIG. 6.

FIG. 8 is a schematic block diagram of electrical circuitry 130 of the master toy vehicle 110 and includes an RF receiver indicated at 132, the output of which is conditioned and sent to the control circuit 130 of the master toy vehicle 110, preferably a commercially available, R/C vehicle microprocessor or microcontroller 134. The microcontroller 134 interprets the radio signals received by the RF receiver 132 from a hand radio transmission remote control unit (not depicted) sending control signals to the master toy vehicle 110. The microcontroller 134 provides an output in the form of an appropriate control signal on parallel lines 135 to a driver circuit 136 for a propulsion motor 138 and a separate output in the form of separate appropriate control signals on parallel lines 139 to a driver circuit 140 for the steering motor 142. Preferably, each motor 138, 142 is reversible and can reversibly be supplied power by the driver circuits 136, 140, respectively. The tracking signal source is indicated generally at 115 and, preferably comprises a plurality of individual IR LED's, wherein four being indicated at 144–147, which are oriented at 90° angles to one another on the top of the master toy vehicle 110. A switching device 151 may be provided to switch or strobe the IR LEDs 144–147 at a particular frequency such as at a frequency between about 15–75 KHz so that the slave toy vehicle 20 can be "tuned" to detect that particular frequency and filter out ambient noise and the like. A simple on-off switch 150 couples the remainder of the circuitry 130 to a battery power supply 152.

Figure 9:
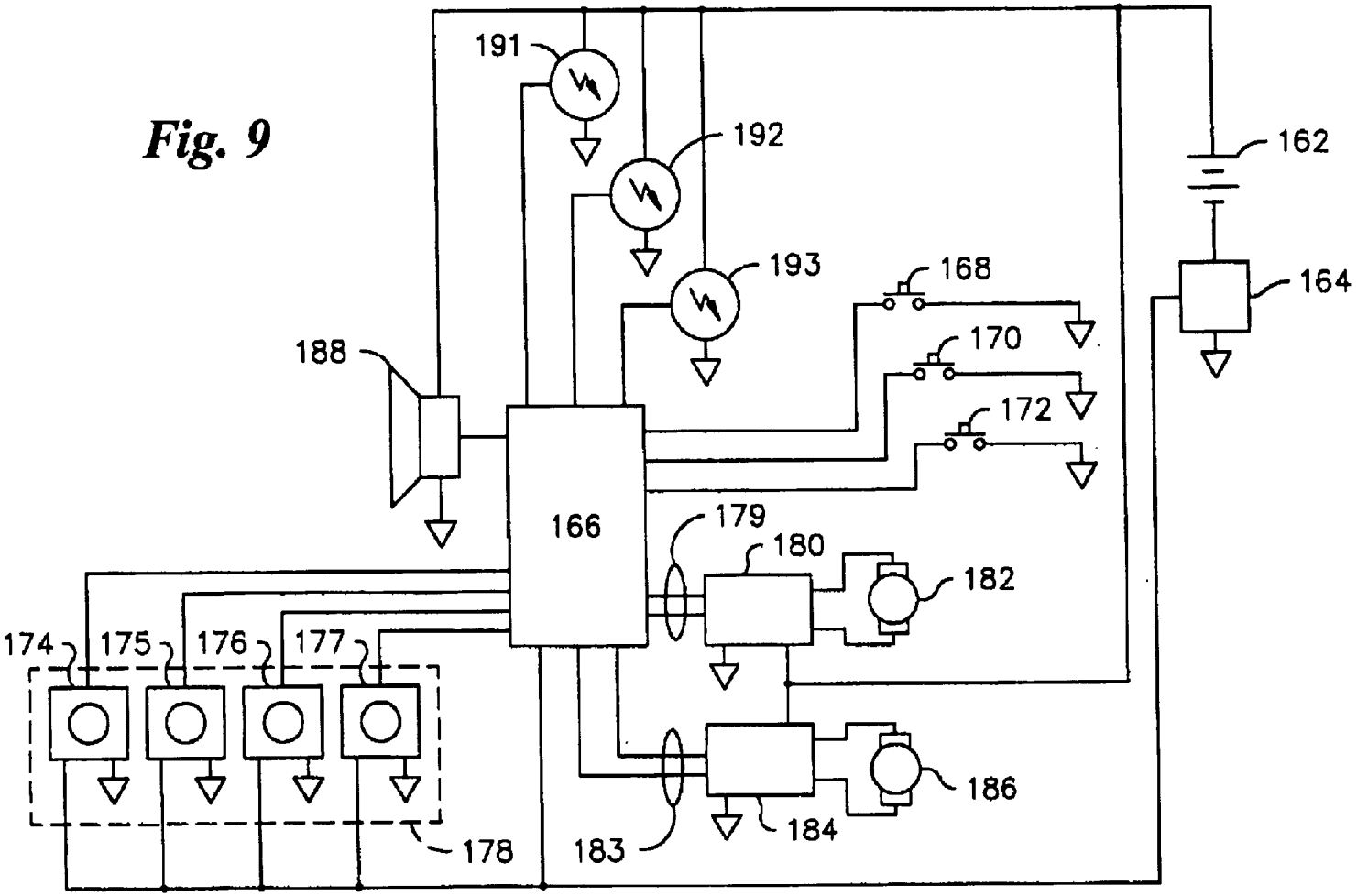
FIG. 9 is an electrical schematic diagram of the major components of the electrical circuitry of the second slave toy vehicle of FIG. 7.

FIG. 9 is a schematic block diagram of the electrical circuitry 160 of the slave toy vehicle 120. Power to the circuitry 160 is supplied from a battery power supply 162 through a power switch 164. A control circuit in the form of a microprocessor or microcontroller 166 preferably receives input signals from three momentary closure switches: a mode switch 168, a front bumper switch 170, and a rear bumper switch 172. The microcontroller 166 also preferably receives signals continuously from a plurality of directional receivers in the form of four IR sensors depicted at 174–177. The microcontroller 166 can receive fresh inputs during each of its operating program cycles. The IR sensors 174–177 may be mounted on a separate board 178 (phantom) for installation at a location in the slave toy vehicle 120 remote from the remainder of electrical components. The microcontroller 166 controls a left motor drive circuit 180 through parallel line output 179 powering the left side drive motor 182 and a right side drive motor circuit 184 through parallel line output 183 independently powering the right side drive motor 186. Each motor 182, 186 can be configured to drive one or more of the three road wheels 317 and 334 located on the each side of the slave toy vehicle 120, which is generally referred to in the art as "tank" steering. The slave microcontroller 166 is further configured to control the first and second outputs 179, 183 based upon internal control programming in conjunction with the signals received by the plurality of directional receivers 174–177.

To enhance play value, the microcontroller 166 also can be programmed to generate sounds and sound effects through a speaker 188 and may generate certain lighting effects by illuminating one or more visible light LEDs, three being shown at 191–193. The microcontroller 166 can be made to respond to inputs from the mode switch 168 by selecting the manner and/or time duration of play or otherwise varying the degree of difficulty of play. For example, the slave toy vehicle 120 can be set for automatic operation for predetermined lengths of time. If the driver of the master toy vehicle 110 can elude the slave toy vehicle 120 for the predetermined period of time, it will have won the contest. The slave 120 can stop driving itself and can provide sound and/or light effects to signal that the game is over. The microprocessor/microcontroller 166 can also be programmed for different styles of operation from a simple tracking scheme to more complicated prediction and interception schemes.

Figure 10:
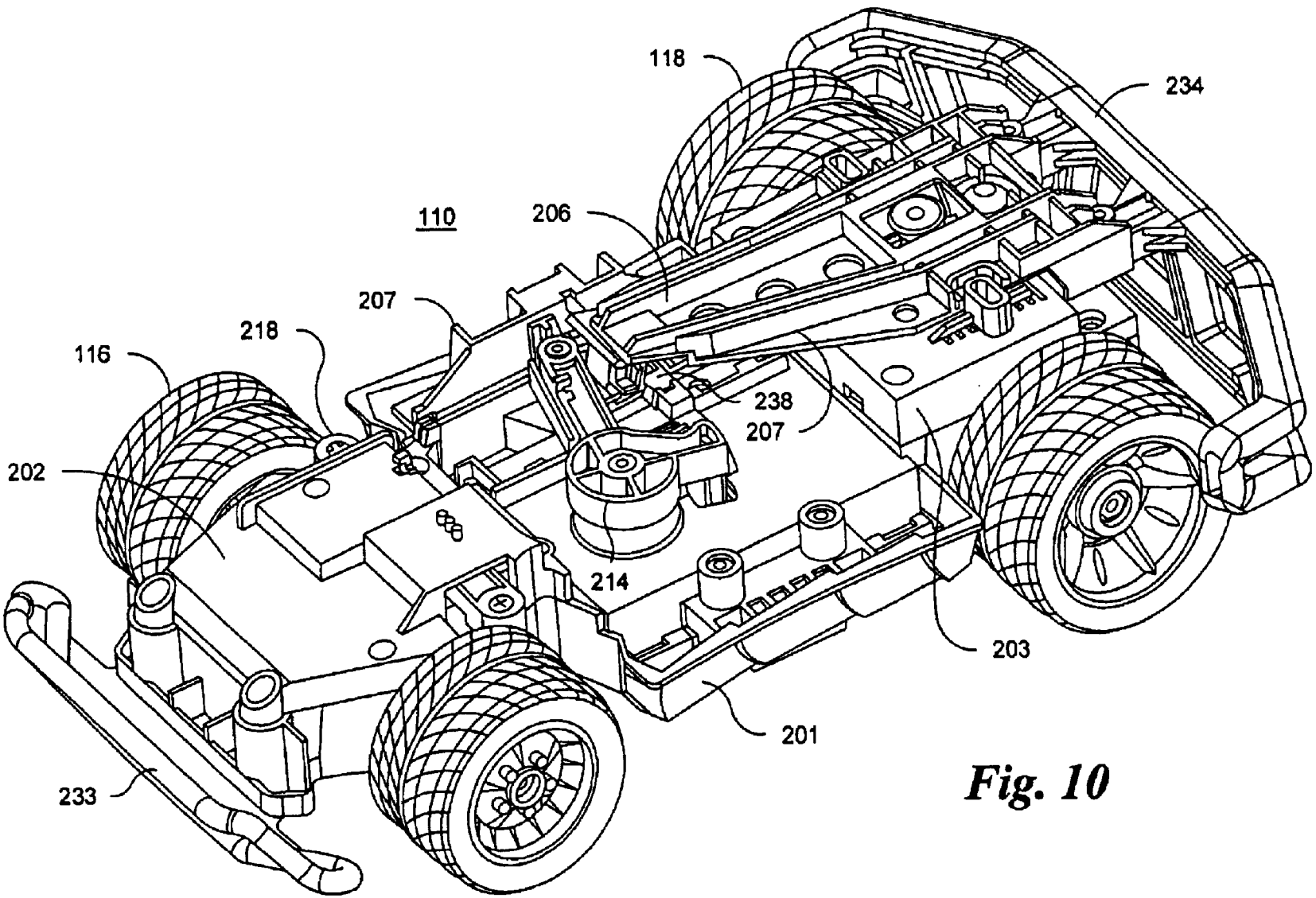
FIG. 10 is a perspective view of the vehicle of FIG. 6 with the body removed.
Figure 11:
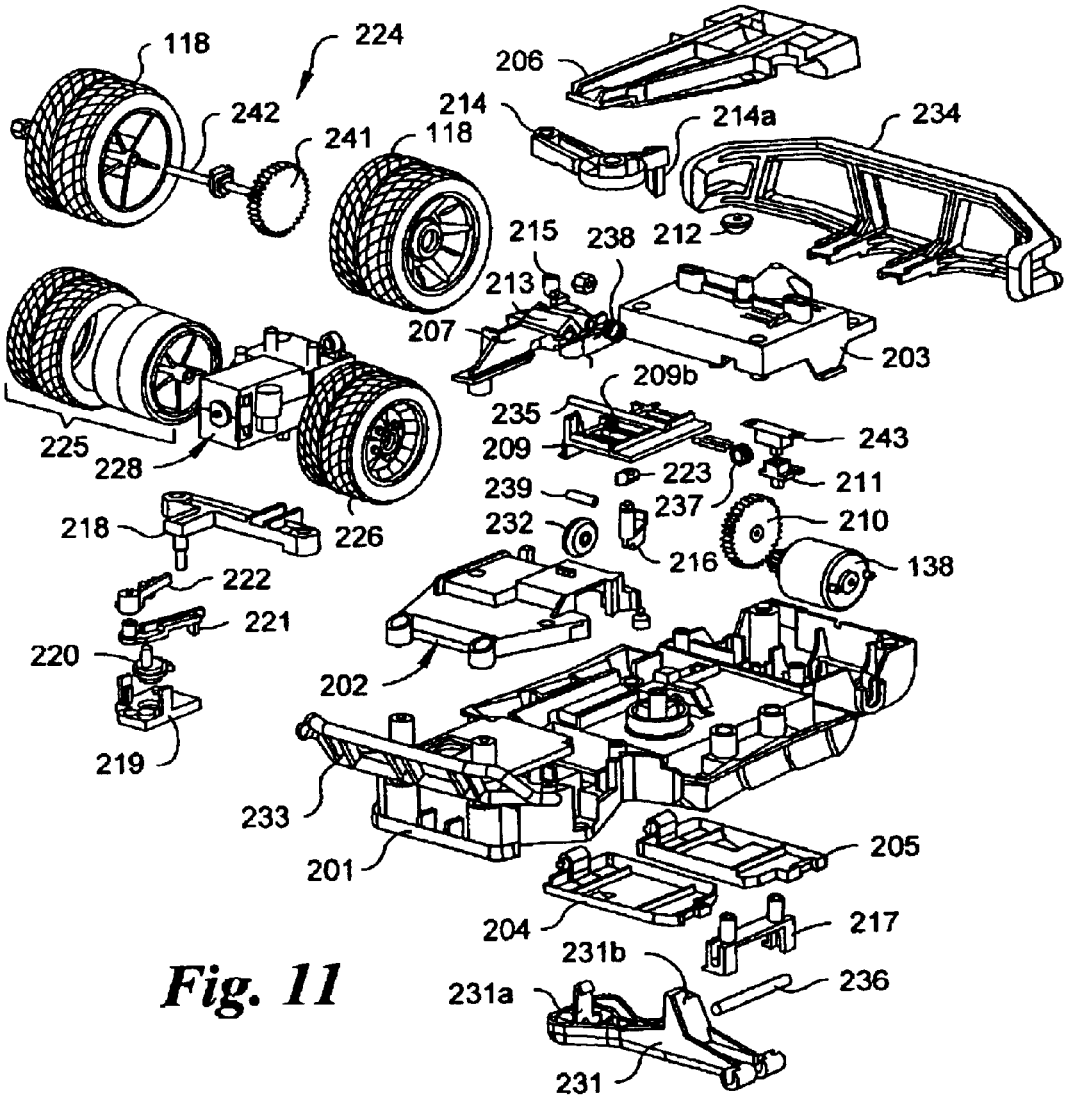
FIG. 11 is an exploded view of the FIG. 10 vehicle.

FIGS. 10–11 depict the operative mechanical components of the master toy vehicle 110 including an optional mechanical subassembly in the master toy vehicle 110 which causes the vehicle 110 to be flipped over after it has been bumped in a rear bumper 234 a predetermined number of times by the slave toy vehicle 120. In FIGS. 10 and/or 11, the major components of master toy vehicle 110, apart from the signal source 115 and electronic control board (not depicted) are a chassis 201, a front chassis cover 202, rear chassis cover 203 and front and rear battery doors 204 and 205 on the bottom of chassis 201. A compound reduction gear 210 is driven by propulsion motor 138, and drives a main drive gear 241 secured to a solid rear axle 242 between the rear wheels 118. A cover 211 protects an on/off switch 243. Steering is provided by a steering arm 218, which is coupled with a steering box assembly 228. A mechanism for centering the front steering includes an adjustment board 219, an adjustment bus 220 and left and right adjustment arms 221 and 222. Right front wheel assembly 225 and left front wheel assembly 226 are conventional and coupled with the steering arm in a conventional manner on the steering box assembly 228. Steering box assembly 228 houses a clutched electric motor which moves steering arm 218 side to side to rotate the front wheels 225, 226, which are pivotally coupled with the chassis 201 between 201 and cover 202 and the outer ends of the arm 218. Each front wheel 226 is mounted on a hub 216 (obscured by 228 in FIG. 11) having a king pin 216*a* pivotally captured between 201, 202 and a control arm 216*b* pivotally received in a bore 218*a* at one end of steering arm 218. Front bumper 233 is shown mounted to the chassis 201. The rear bumper 234 is received in a rear bumper plate 206 movably mounted on cover 203.

Pivotally attached to the bottom of the chassis 201 is a flip arm 231 mounted to rotate on axle 236 held by retainer 217. Flip arm 231 receives in its outer end (left in FIG. 11) a flip wheel 232 supported on a flip axle 239. The release mechanism for that arm 231 is coupled with the rear bumper 234 through rear bumper plate 206. It includes a latch plate retainer 207, a latch plate 209 and a pawl 213. First and second levers 214 and 215 are used to reset the arm 231. Also depicted are a pawl axle 235, flip axle 236, a flip torsional spring 237 and a pawl torsional spring 238. Hook 231*a* on arm 231 engages ledge 209*a* of plate 209. Plate 209 is preferably biased forward (or backward) on the chassis 201 by suitable means such as a spring (not depicted) and is permitted to incrementally advance by pawl 213. Pawl 213 engages in sequence a plurality of wells along the plate 209, one of which is identified at 209*b*. Pawl 213 is rocked on its support shaft 235 each time the rear bumper 234 is struck. Movement of the bumper 234 is transferred to plate 206, which is mounted on rear cover 203 to rotate and then release pawl 213 allowing plate 209 to advance one well 209*b*. After the bumper 234 has been struck a predetermined number of times, the plate 209 advances far enough to release or cause the release of hook 231*a* from ledge 209*a*. The mechanism is reset with arms 214 and 215. When the arm 231 is rotated back into the chassis 201 after being released, cam surface 231*b* contacts leg 214*a* or arm 214 causing the arm 214 to rotate. Arm 214 retracts plate 209 through second arm 215, which is biased to hook plate 209 and drag it back to its initial position. Alternatively to being spring advanced, the mechanism can be configured to advance the plate 209 with the pawl 213. Alternatively, release of the arm 231 can be controlled by the microcontroller 166 operating a solenoid or magnetic latch or the like to release the arm 231 in response to a signal generated when the rear bumper switch 172 is struck a sufficient number of times.

Figure 12:
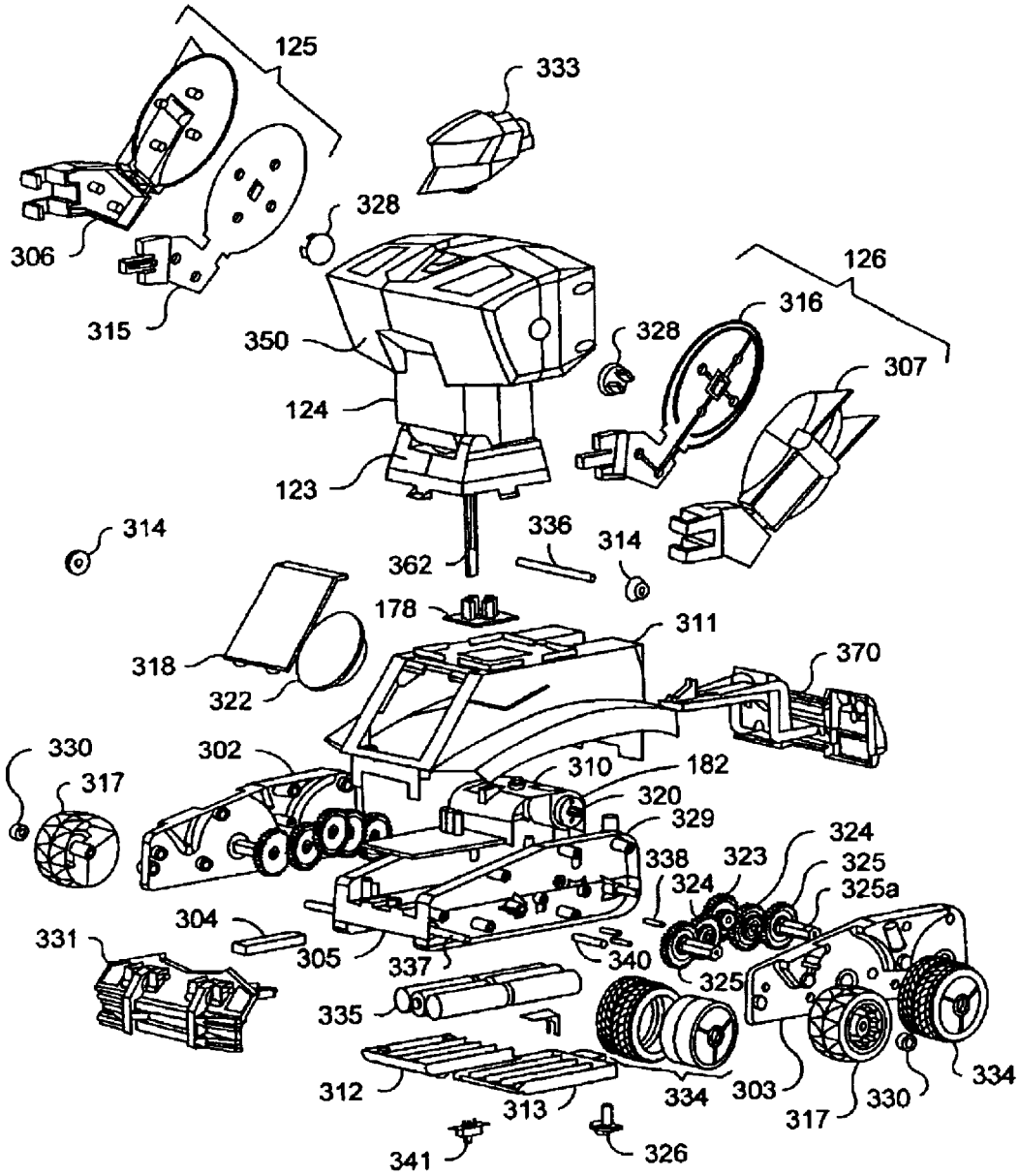
FIG. 12 is an exploded view of the second slave toy vehicle of FIG. 7.
Figure 13:
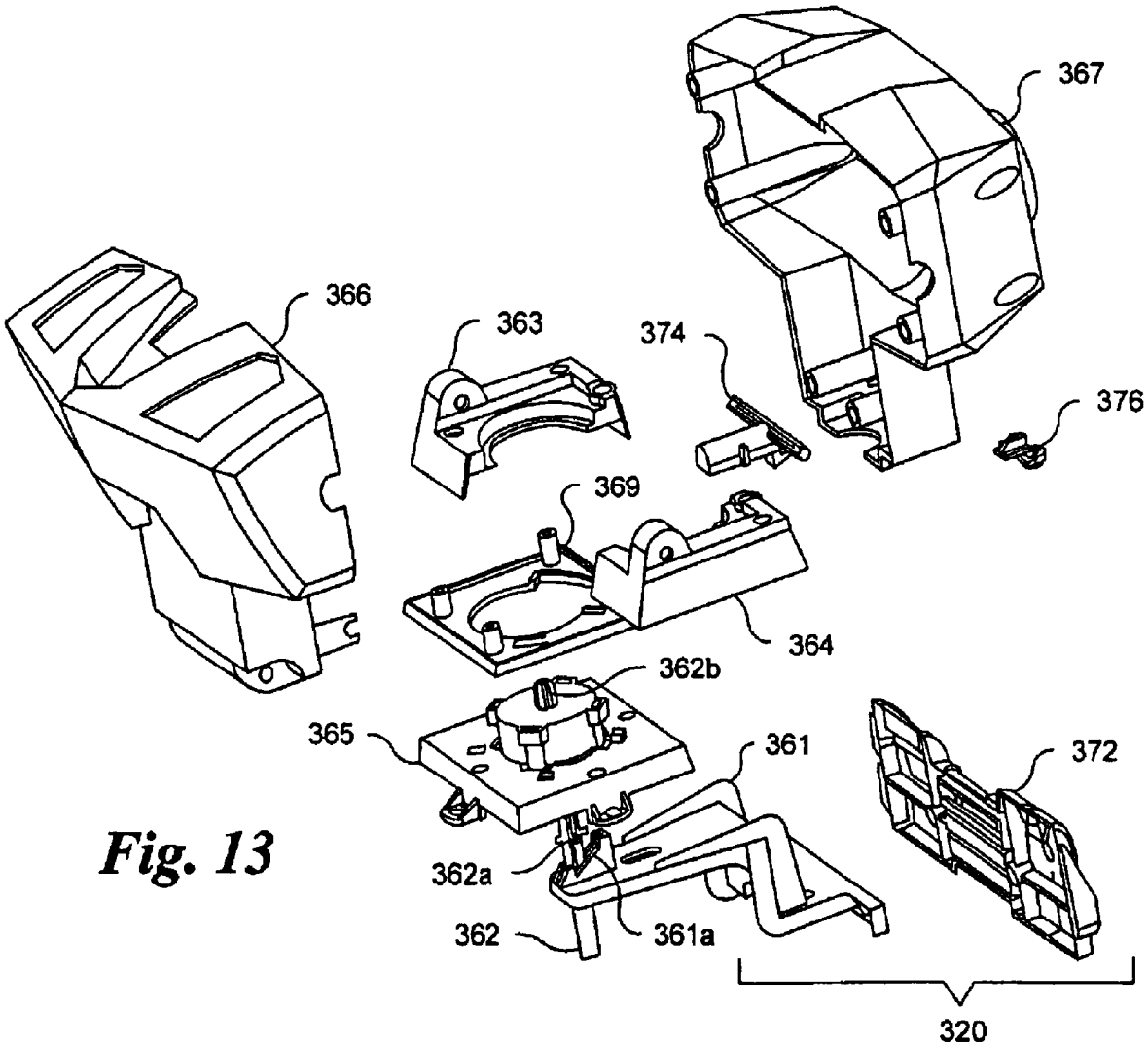
FIG. 13 is an exploded view of the torso component of FIG. 12.

FIGS. 12–13 are exploded views of the mechanical components of the slave toy vehicle 120 of FIG. 7 including components of an optional mechanism in the slave toy vehicle 120 for causing the upper torso portion 124 of the slave toy vehicle 120, generally forming a robot upper torso portion 124 atop the slave toy vehicle chassis cover 311 and chassis 121, to pitch forward on its pedestal 123 after the rear bumper 370 of the slave toy vehicle 120 has been contacted sufficiently hard to disable the slave toy vehicle 120. Major components of the slave toy vehicle 120 shown in FIG. 7 are separately indicated in FIGS. 12 and 13. They include two reversible electric motors, the left one of which 182 is seen in FIG. 12, the other one (186 in FIG. 9) being coaxial with the left motor 182 and extending from the other side of motor cover 310. Each of the motors 182, 186 includes a pinion 329 for mounting. The motors 182, 186 and motor cover 310 are received in a main chassis 305 between which a plurality of gear train members 323, 324 and 325 are captured by right and left gear box covers 302, 303, respectively. Pinion 329 engages main compound drive gear 323 which through compound reduction gears 324 drive wheel drive gears 325. Two rear wheel assemblies 334 and a front wheel 317 are mounted on each side. Each of the rear wheel assemblies 334 keys with the drive shaft 325*a* on each of the wheel drive gears 325. The front wheels 317, which are unpowered, are mounted to a front axle 337 by nuts 330. A front bumper 331 is mounted to the chassis 305 by retainer 304. Battery covers 312 and 313 are provided on the bottom of the chassis 305 to retain battery powered supply 335. Mounted at the top of the chassis 305 is cover 311 and mounted to it pedestal 123 supporting the robot upper torso portion 124. The pedestal 123 receives a daughter board 178 with four IR sensors (e.g. 174–177 of FIG. 9). Preferably, the sensors 174–177 are oriented to provide at least some overlapping coverage directly in front of vehicle 120. Appropriate ports can be provided through the cover 311, through the pedestal 123 of between the cover 311 and pedestal 123 to provide appropriate viewing lanes to the sensors. A housing 350 of the upper torso portion 124 is pivotally mounted to pedestal 123 by means of a pivot pin 336 held in position by retainers 314. Also mounted in the cover 311 are a speaker 322 and a speaker cover 318. Further mounted to the housing 350 of upper torso portion 124 by ratchet retainer pins 328 are right and left robot arms 125, 126, formed by outer arm members 306 and 307 and inner arm covers 315 and 316, respectively. A head 333 is mounted atop the robot torso 332. Finally, a rear bumper assembly 370 is received in the rear end of the member 311.

Referring to FIG. 13, the rear bumper assembly 370 is provided by a rear bumper mount 361 supporting a rear bumper member 372. The forward end of the rear bumper mount 361 has a slot which engages a push rod 362, which extends downward from a baffle plate 365 forming part of the pedestal 123. Also included in the pedestal 123 are a pivot plate 369, and a latch 374, cooperating with a catch 376 on cover 311 (FIG. 12), all trapped between right and left journal members 363, 364. These pivotally support front and back torso shells 366 and 367, respectively. When struck in the rear bumper element 372, the rear bumper mount 361 slides forward and cam surface 361*a* on mount 361 forces pin 362*a* and push rod 362 upward. Tip 362*b* of rod 362 rises through plate 365 rotating latch 374 releasing it from catch 376. The upper torso portion 124 can be weighted (or spring biased) to pitch forward on the pedestal 123 indicating completion of the game. Springs or other biasing means can be provided, if desired or needed, to return the movable components to their original positions. The torso portion 123 would have to be manually reset, however.

Broadly speaking, the second preferred toy vehicle combination includes the master toy vehicle 110 and the slave toy vehicle 120. Each toy vehicle 110, 120 includes a chassis 201 or 305 with a plurality of supporting road wheels 116, 118, 317 or 334, a first motive system 136–138, 180–182 or 184–186 drivingly coupled to at least one of the plurality of road wheels 116, 118, 317 or 334 so as to propel the chassis 201 or 305 and a steering system 140–142, 180–182 or 184–186 operably coupled to at least one of the plurality of road wheel 116, 118, 317 or 334 so as to steer the chassis 201 or 305. The master toy vehicle 110 includes the tracking signal source (transmitter) 115 configured to broadcast a tracking signal, the RF receiver 132 configured to receive signals from the RF remote control, the first control circuit 130 having a first output connected to the motive system 136–138 of the master toy vehicle 110 and a second output connected to the steering mechanism 140–142 of the master toy vehicle 110. The first control circuit 130 is configured to control the first and second outputs of the first control circuit 130 based upon signals received by the RF receiver 132. The slave toy vehicle 120 includes at least first and second directional receivers 174–177 configured to receive the tracking signal from the tracking signal source 115 from different directions around the slave toy vehicle 120, the second control circuit 160 coupled to the first and second directional receivers 174–177, a first output connected to the motive system 180–182 and 184–186 of the slave toy vehicle 120, a second output connected to the steering system 180–182 and 184–186 of the slave toy vehicle 120. The second control circuit 160 is configured to control at least one of the first and second outputs of the second control circuit 160 based upon signals received by the first and second directional receivers 174–177.

It is contemplated that both the master and slave toy vehicles 110, 120 utilize conventional axle steering or that both utilize tank steering. But, the steering of the master and slave toy vehicles 110, 120 can be any suitably known steering-type with departing from the present invention.

Figure 14:
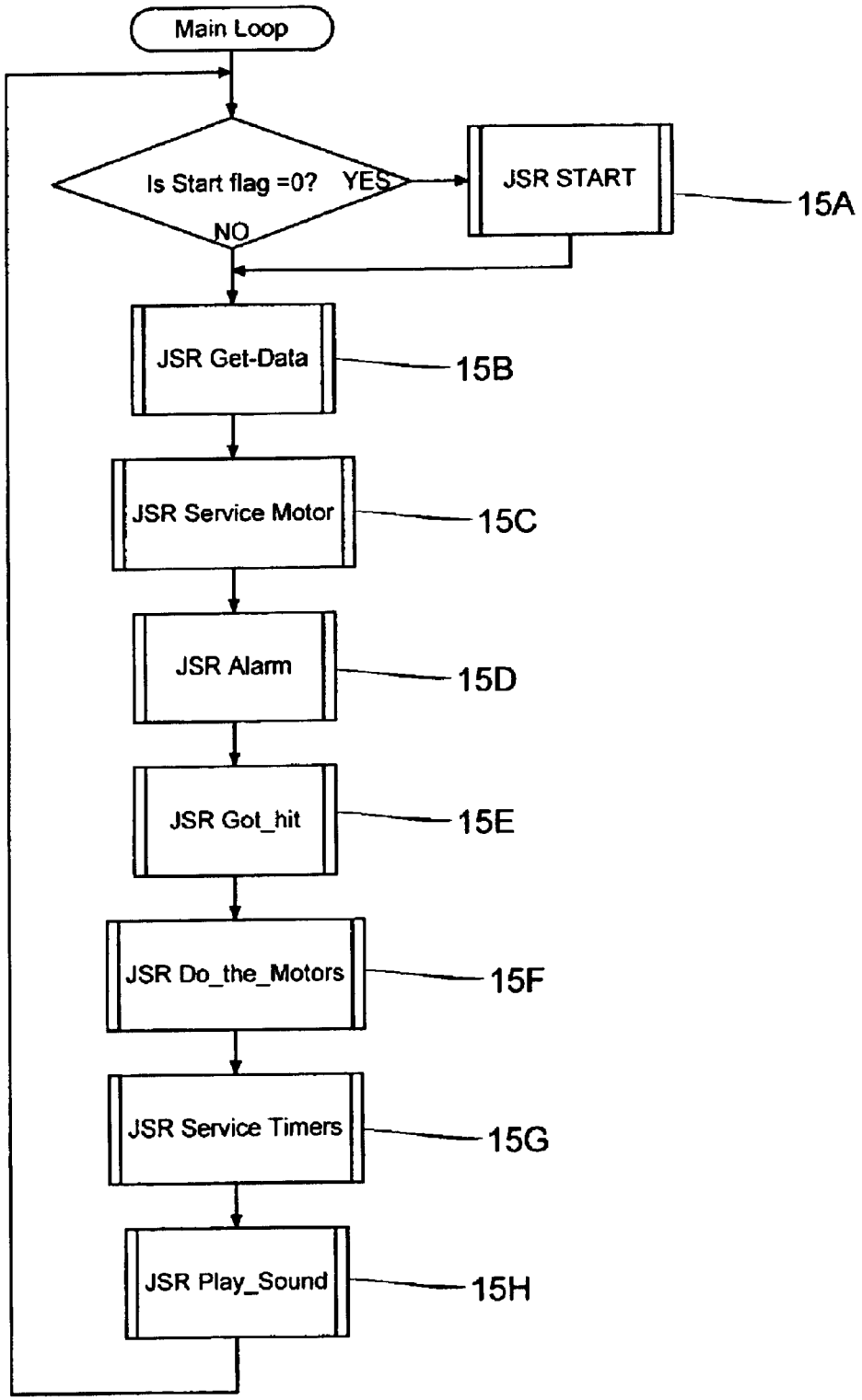
FIG. 14 is a flow diagram depicting a synopsis of a software routine for controlling a slave toy vehicle in accordance with the present invention.
Figure 15A:
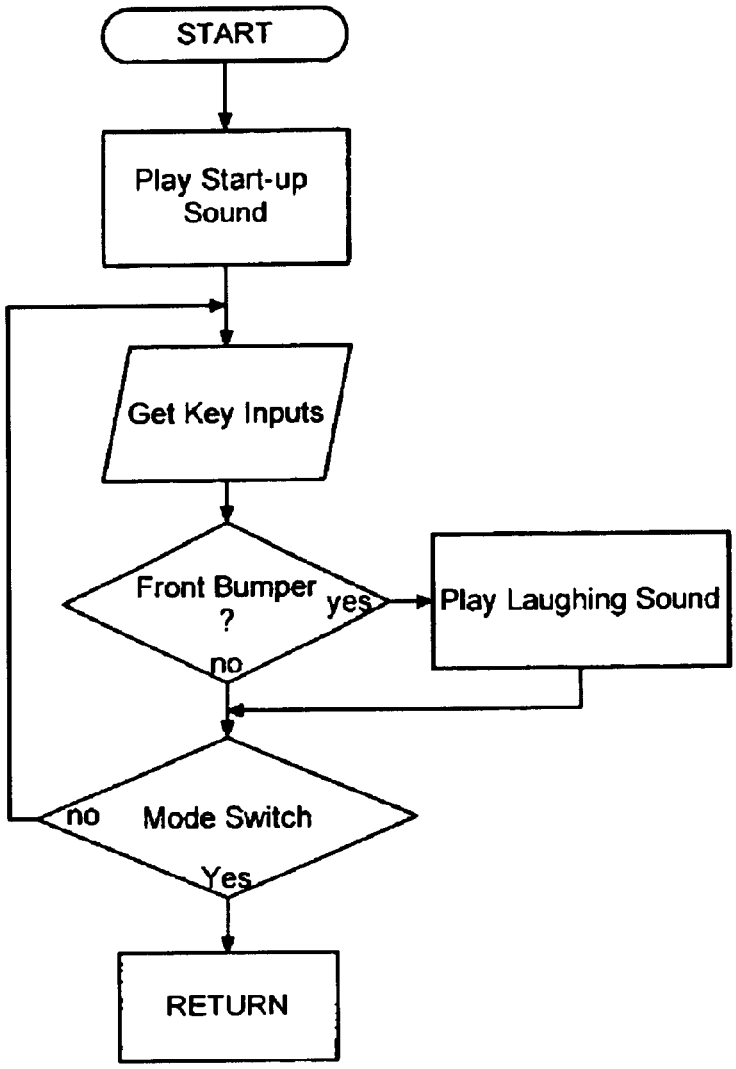
FIGS. 15A–15H are flow diagrams that each depict a synopsis of a software subroutine for the software routine of FIG. 14.
Figure 15B:
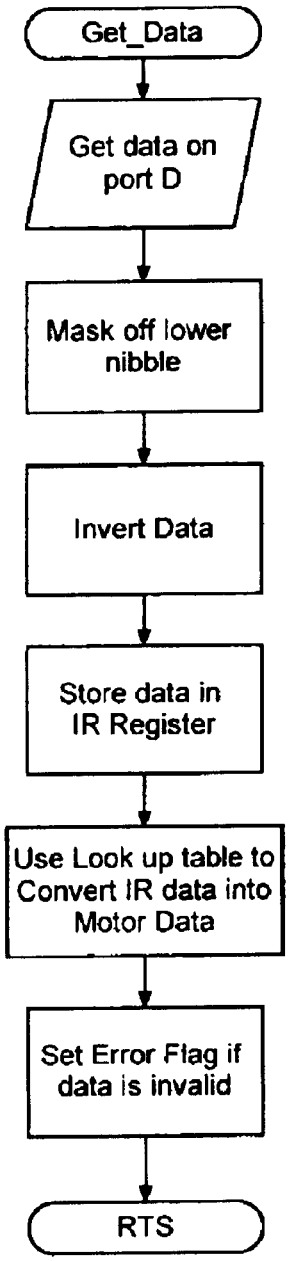
Figure 15C:
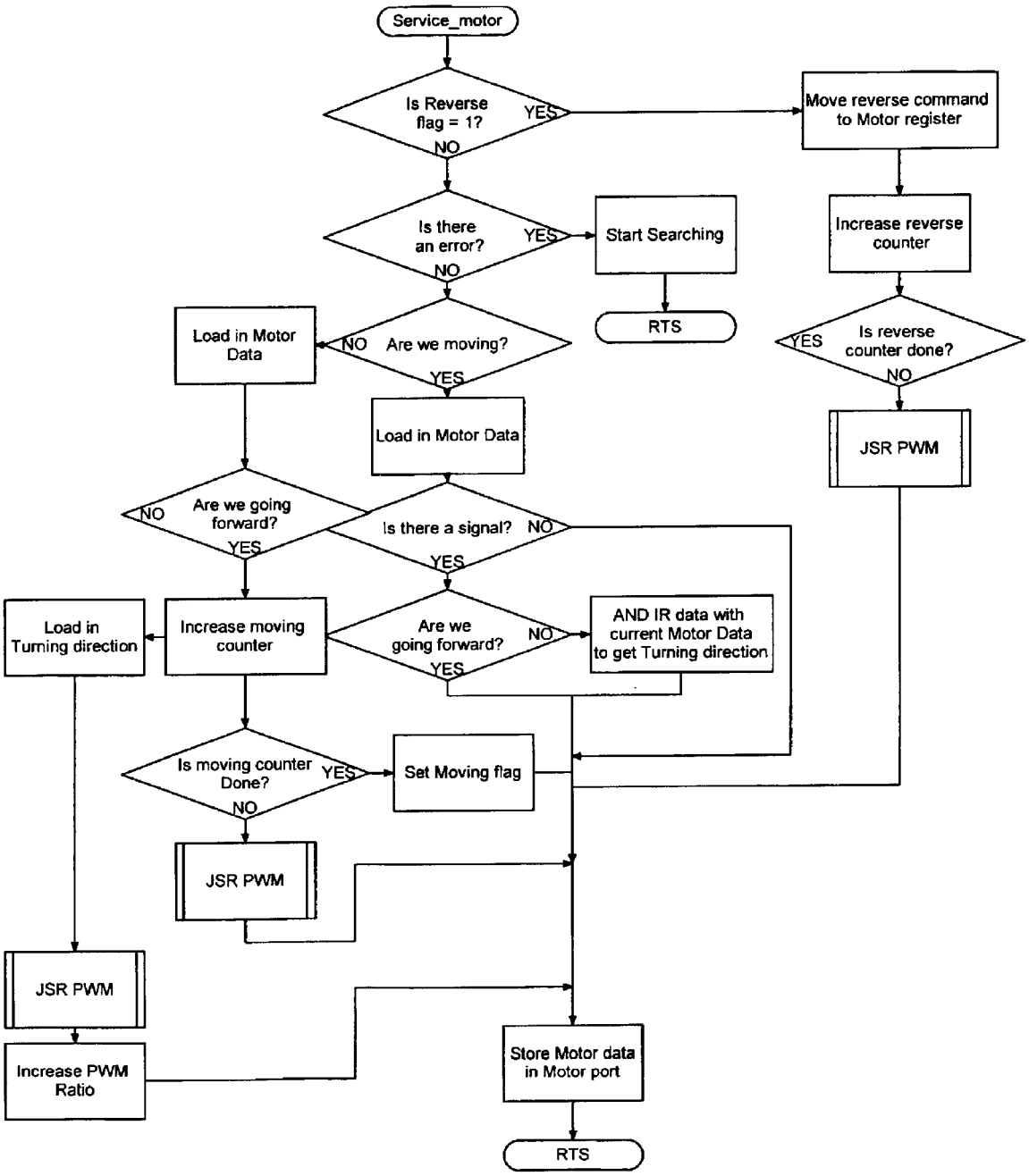
Figure 15D:
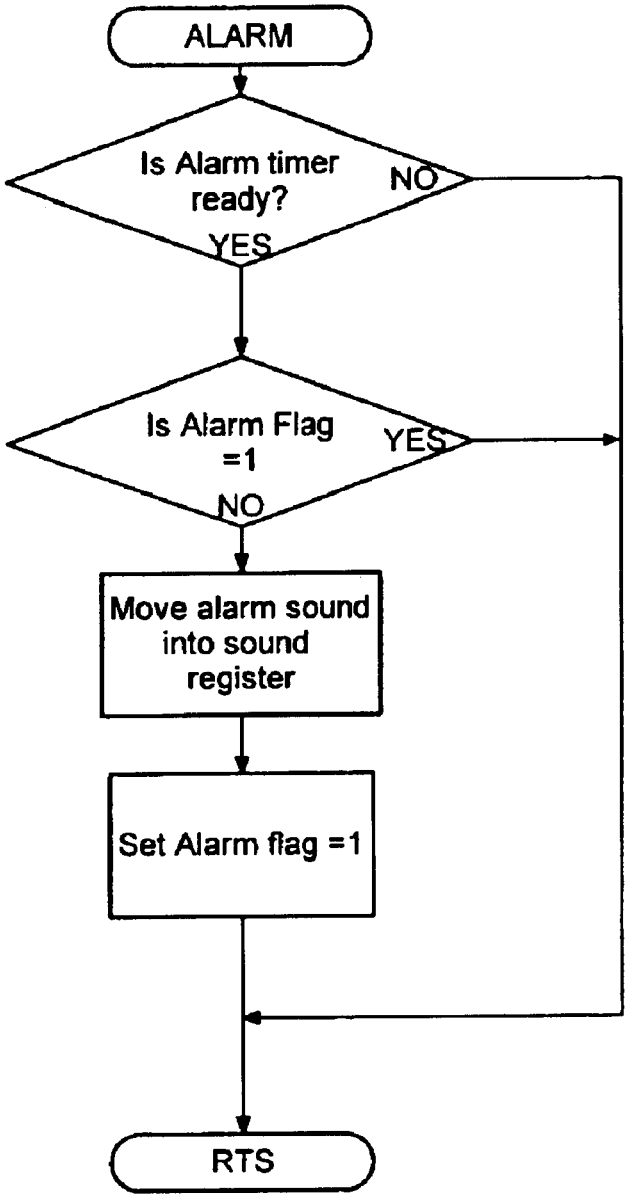
Figure 15E:
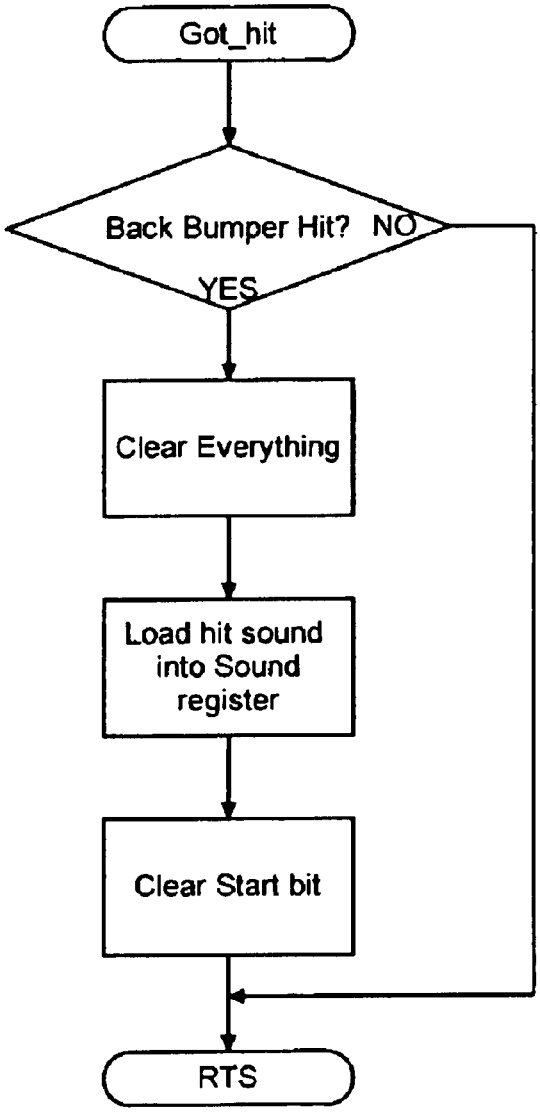
Figure 15F:
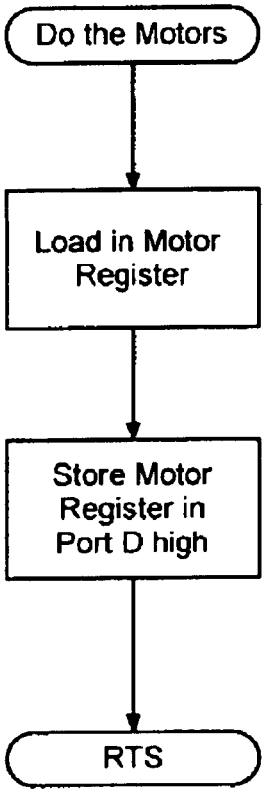
Figure 15G:
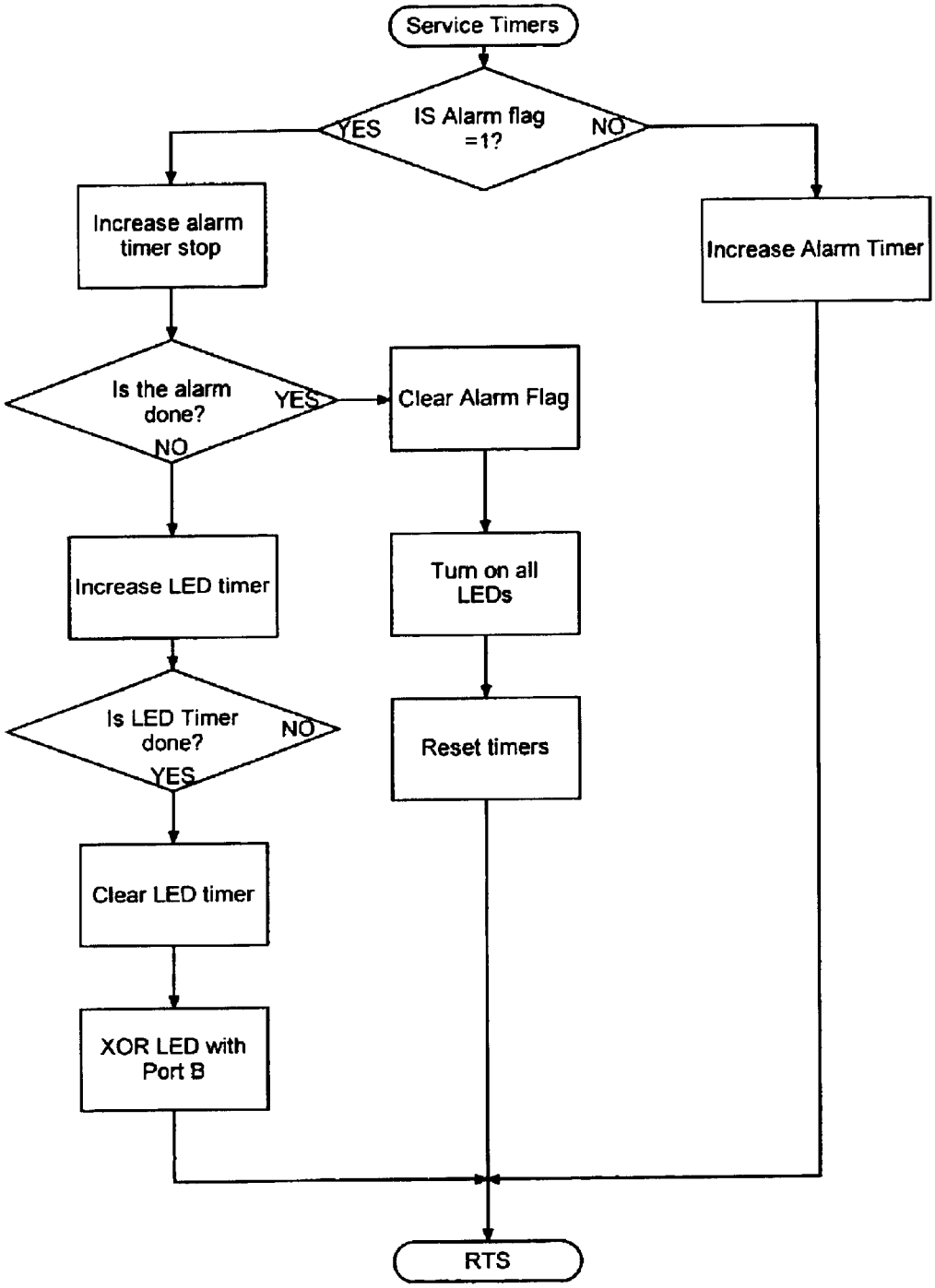
Figure 15H:
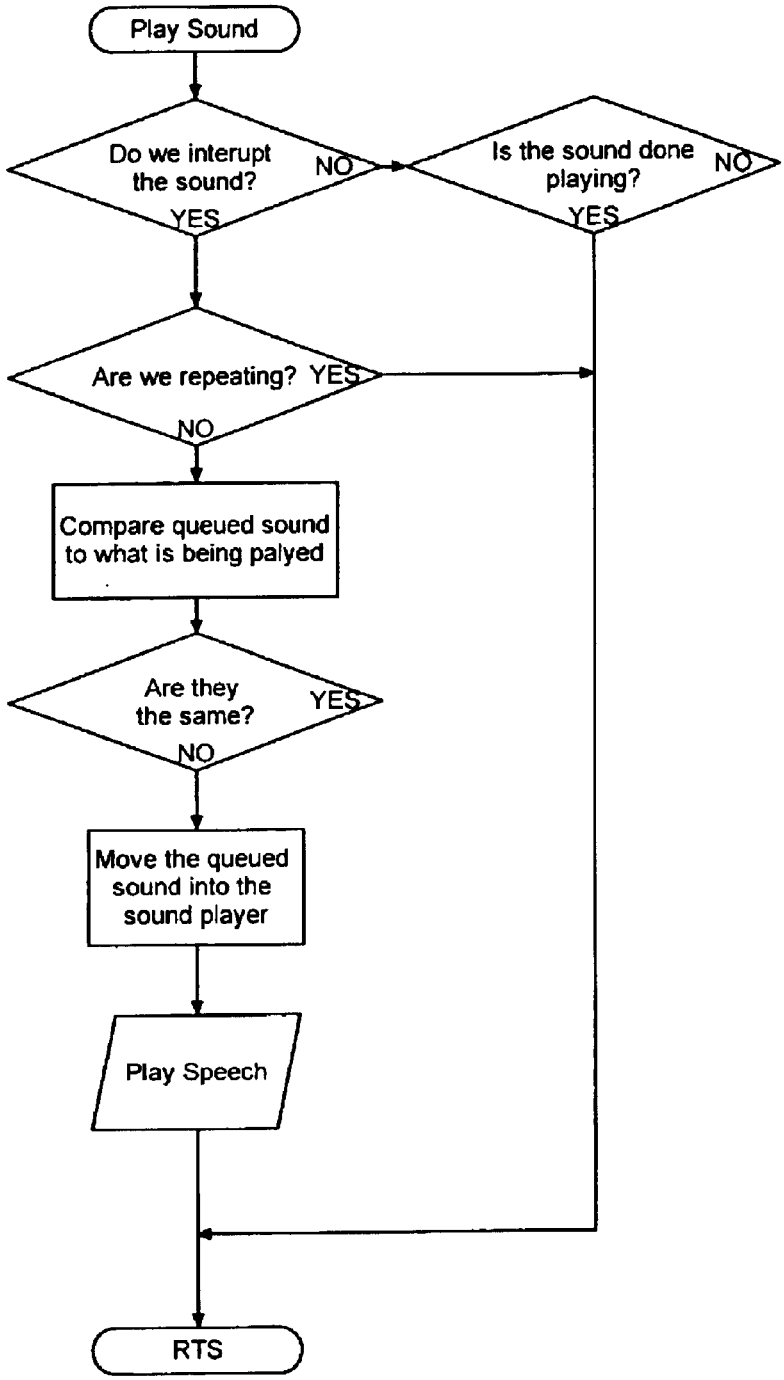

FIGS. 14 and 15A–15H are flow diagrams depicting a synopsis of one possible implementation of a software routine for the slave toy vehicle 120. FIG. 14 is a main software routine and generally calls subroutines (15A–15H) including start (FIG. 15A), Get-Data (FIG. 15B), Service Motor (FIG. 15C), Alarm (FIG. 15D), Got-hit (FIG. 15E), Do_the_motors (FIG. 15F), service timers (FIG. 15G) and Play_sound (FIG. 15H). Other software routines and subroutines may be implemented in the microcontroller 166 of the slave toy vehicle 120 as would be obvious to one skilled in the art in order to achieve play patterns and variations of play patterns as described herein without departing from the present invention.

One suggested play pattern of the master and slave toy vehicles 110, 120 is as follows and can be implemented in other combinations such as master and slave toy vehicles 10 and 20. The player drives the master toy vehicle 110 using a supplied, conventional, hand-remote control unit having at least two switches or toggles for propulsion and steering direction control, respectively. The slave toy vehicle 120 can be set for different time lengths that it will pursue the master toy vehicle 110. This is accomplished after the slave toy vehicle 120 is turned on by depressing the mode control switch 168. For example, one, two or three switch depressions may signal for three, five and ten minute play lengths, respectively. This enables the combination of the master and slave toy vehicles 110, 120 to be made more challenging as the user skill increases. Preferably, there is a delay period between the time when the slave toy vehicle 120 is turned on and the operating mode entered and when the slave toy vehicle 120 begins seeking the master toy vehicle 110 to enable the user to set up the slave toy vehicle 120 and then take control of the master toy vehicle 110. For example, sound and/or lighting effects may be generated by the microcontroller 166 as a prelude to movement of the slave toy vehicle 120. The master toy vehicle 110 is preferably configured to respond to impact in the rear of the master toy vehicle 110 by the slave toy vehicle 120. This can be done electronically by the provision of momentary contact switch (not depicted) operably coupled between the rear bumper and the microcontroller 166. Otherwise the optional arm mechanism of FIG. 11 will flip vehicle 110 over after it has been struck three times by the robot/slave 120. The front bumper switch 170 is preferably provided on the slave toy vehicle 120 to cause the slave toy vehicle 120 to back away from any object it hits with the front bumper. For example, when pursuing the master toy vehicle 110, the robot vehicle 120 will back away from the master toy vehicle 110 after contacting its rear bumper to give the master toy vehicle 110 an opportunity to escape. Also, if the slave toy vehicle 120 encounters an obstacle like a wall, it will back away from the obstacle and turn towards the master toy vehicle 110 if detected, or begin a series of backing and turning maneuvers to try to seek out the master toy vehicle 110. Slave toy vehicle 120 is further provided with rear bumper switch 172 as part of another play feature. If the master toy vehicle 110 can strike the rear bumper of the slave toy vehicle 120, the slave toy vehicle 120 responds by shutting itself down, indicating termination of the game.

Thus, the toy vehicle combination of the master and slave toy vehicles 110, 120 is used as a chase game. The chase game comprises the steps of controlling the master toy vehicle 110 using the remote control, automatically following the master toy vehicle 110 with the slave toy vehicle 120 using the tracking signals being emitted from the master toy vehicle 110, and counting a number of times the slave toy vehicle 120 collides with the master toy vehicle 110 in order to track a collision count. The chase game further comprises the step of at least temporarily disabling the master toy vehicle 110 electronically when the collision count reaches a predetermined limit thereby indicating that a contest is over. The chase game further comprises the step of flipping the master toy vehicle 110 using an at least partially internally mounted toy vehicle flipping mechanism or flip arm 231 when the collision count reaches a predetermined limit thereby indicating that a contest is over.

It is also contemplated that the toy vehicle combination of the master and slave toy vehicles 110, 120 is used as another type of chase game. The alternate chase game comprising the steps of operating the slave toy vehicle 120 into an evasive mode wherein the slave toy vehicle 120 automatically avoids the master toy vehicle 110 using the tracking signals being emitted from the master toy vehicle 110, controlling the master toy vehicle 110 using the remote control to chase the slave toy vehicle 120 and colliding into the slave toy vehicle 120 with the master toy vehicle 110 in order to score. The depicted slave toy vehicle 120 is further preferably provided with the mechanical latch release mechanism shown in FIG. 13, which releases the rear end of the robot upper torso portion 124 from the catch causing the torso portion 124 to pitch forward on the chassis 121 and pedestal 123 indicating that the game has been terminated because the robot vehicle 120 was successfully struck. Again, appropriate sound and/or lighting effects can be preprogrammed into the microcontroller 166.

Optionally, the slave toy vehicle 120 can be provided with certain other features to enhance the play versatility of the combination of the master and slave toy vehicles 110, 120. For example, the slave toy vehicle 120 can be preprogrammed to stop chasing the master toy vehicle 110 for a brief period of time, during which time the slave toy vehicle 120 can more easily be approached by the master toy vehicle 110 to disable the slave toy vehicle 120. The length of time that the slave toy vehicle 120 is inactivated can be randomized, preferably within a range (e.g., two to ten seconds). The powering down and subsequent powering up of the slave toy vehicle 120 during this period can be denoted by sound and/or light effects, if desired. Instead of providing predetermined play period lengths for varying the degree of difficulty, the number of times and/or duration of the periods that the slave toy vehicle 120 goes inactive can be varied. For example, the slave toy vehicle 120 can be disabled regularly but randomly within a range of time periods for an inactive period that can also randomly vary within a range. The play can be made more difficult by increasing the time periods between deactivation of the slave toy vehicle 120 and/or reducing the range of the length of periods the slave toy vehicle 120 is inactive. The visible light LED's 191–193 can further be used to indicate the mode or the number of times the slave toy vehicle 120 has struck the master toy vehicle 110.

From the foregoing, it can be seen that the present invention comprises a combination of master and slave toy vehicles that communicate wirelessly for interaction. It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A toy vehicle combination comprising:

a master toy vehicle and a slave toy vehicle, each toy vehicle including:

a chassis with a plurality of supporting road wheels;

a motive system drivingly coupled to at least one of the plurality of road wheels so as to propel the chassis; and a steering system operably coupled to at least one of the plurality of road wheels so as to steer the chassis; and wherein the master toy vehicle includes a transmitter configured to broadcast a tracking signal, a radio frequency (RF) receiver configured to receive signals from an RF remote control, a master toy vehicle control circuit having a first output connected to the motive system of the master toy vehicle and a second output connected to the steering system of the master toy vehicle, the master toy vehicle control circuit being configured to control the first and second outputs of the master toy vehicle control circuit based upon signals received by the RF receiver, and wherein the slave toy vehicle includes at least first and second directional receivers configured to receive the tracking signal from the transmitter from different directions around the slave toy vehicle, a slave toy vehicle control circuit coupled to the first and second directional receivers, a first output connected to the motive system of the slave toy vehicle, and a second output connected to the steering system of the slave toy vehicle, the slave toy vehicle control circuit being configured to control at least one of the first and second outputs of the slave toy vehicle control circuit based upon signals received by the first and second directional receivers so as to either chase or move so as to avoid the master toy vehicle.

2. The toy vehicle combination according to claim 1, wherein the steering system of at least one of the master and slave toy vehicles includes steering arm movably coupled to the chassis and to at least one of the plurality of road wheels and configured to pivot the at least one of the plurality of road wheels to steer the at least one toy vehicle.

3. The toy vehicle combination according to claim 1, wherein the motive system of at least one of the master and slave toy vehicles is drivingly coupled to one or more road wheels on only a first lateral side of the chassis of the at least one toy vehicle and wherein the steering system of the at least one toy vehicle is a second motive system operable independently of the motive system of the at least one toy vehicle and operably coupled to at least one of the plurality of road wheels on only a second lateral side of the at least one toy vehicle chassis opposite the first lateral side.

4. The toy vehicle combination according to claim 1, wherein the transmitter includes at least one light emitting diode and the directional receiver includes at least one directional light detecting sensor.

5. The toy vehicle combination according to claim 1, wherein the slave toy vehicle control circuit is configured to control the first and second outputs further based upon internal control programming in conjunction with the signals received by the at least first and second directional receivers.

6. A method of using the toy vehicle combination of claim 1 as a chase game, the method comprising the steps of:

controlling the master toy vehicle using the remote control; and automatically following the master toy vehicle with the slave toy vehicle using the tracking signals being emitted from the master toy vehicle.

7. The method according to claim 6 further comprising the steps of counting in the master toy vehicle a number of times the slave toy vehicle collides with the master toy vehicle and maintaining a collision count in the master toy vehicle.

8. The method according to claim 7 further comprising the step of at least temporarily disabling the master toy vehicle electronically when the collision count reaches a predetermined limit thereby indicating that a contest is over.

9. The method according to claim 7 further comprising the step of flipping the master toy vehicle over using an at least partially internally mounted toy vehicle flipping mechanism when the collision count reaches a predetermined limit thereby indicating that a contest is over.

10. A method of using the toy vehicle combination of claim 1 as a chase game, the method comprising the steps of:

operating the slave toy vehicle into an evasive mode wherein the slave toy vehicle automatically avoids the master toy vehicle using the tracking signals being emitted from the master toy vehicle; and controlling the master toy vehicle using the remote control to chase the slave toy vehicle.

11. The method of claim 10 further comprising the step of disabling the slave toy vehicle after being struck by the master toy vehicle.

12. The toy vehicle combination according to claim 1, wherein the slave toy vehicle control circuit is configurable to direct the slave toy vehicle towards the master toy vehicle using the tracking signals being emitted from the master toy vehicle.

13. The toy vehicle combination according to claim 12, wherein the master toy vehicle includes at least one switch operably coupled with the master toy vehicle control circuit and mounted to be activated by collision with the slave toy vehicle and wherein the master toy vehicle control circuit is configured to count a number of times the switch is activated and to maintain a collision count of switch activations.

14. The toy vehicle combination according to claim 13, wherein the master toy vehicle control circuit is configured to temporarily disable the master toy vehicle when the collision count reaches a predetermined limit thereby indicating that a contest is over.

15. The toy vehicle combination according to claim 13, wherein the master toy vehicle further comprises an at least partially internally mounted toy vehicle flipping mechanism operated by the master toy vehicle control circuit.

16. The toy vehicle combination according to claim 1, wherein the slave toy vehicle control circuit is configurable to direct the slave toy vehicle to evade the master toy vehicle using the tracking signals being emitted from the master toy vehicle.

17. The toy vehicle combination according to claim 16, wherein the slave toy vehicle control circuit is configured to disable the slave toy vehicle after being struck by the master toy vehicle to end a contest.

* * * * *